United States Patent [19]

Couderc et al.

[11] Patent Number: 4,997,542

[45] Date of Patent: Mar. 5, 1991

[54] IMPREGNATION PITCH WITH IMPROVED FILTERABILITY AND PROCESS FOR ITS MANUFACTURE

[75] Inventors: Pierre Couderc, Bethune; Serge Buche, Lens; Jean-Louis Saint Romain, Saint Laurent Blangy, all of France

[73] Assignee: Norsolor, Paris, France

[21] Appl. No.: 170,332

[22] Filed: Mar. 18, 1988

[30] Foreign Application Priority Data

Mar. 20, 1987 [FR] France ..... 87 03927

[51] Int. Cl.[5] ..... C10G 9/00; C10G 11/00

[52] U.S. Cl. ..... 208/39; 208/22; 208/44; 208/41; 208/42

[58] Field of Search ..... 208/22, 39

[56] References Cited

U.S. PATENT DOCUMENTS

| | | | |
|---|---|---|---|
| 3,692,663 | 9/1972 | Ueda et al. | 208/22 |
| 3,835,024 | 9/1974 | Ueda et al. | 208/22 |
| 3,970,542 | 7/1976 | Bongertman | 208/22 |
| 4,096,056 | 6/1978 | Haywood et al. | 208/39 |
| 4,176,043 | 11/1979 | van Eijk | 208/22 |
| 4,369,171 | 1/1983 | Grindstaff et al. | 208/39 |
| 4,460,557 | 7/1984 | Takashima et al. | 208/22 |
| 4,664,774 | 5/1987 | Chu et al. | 208/39 |

OTHER PUBLICATIONS

Clarke, J. W. and Rantell, T. D., "Filtration in Coal Liquefication. Influence of Filtration Conditions in Non-Hydrogenated Systems," 59, Fuel, 35–41 (1980).

ASTM Standard D-2318-86, Standard Test Method for Quinoline-Insoluble (QI) Content of Tar and Pitch.

*Primary Examiner*—Helane Myers

*Attorney, Agent, or Firm*—Finnegan, Henderson, Farabow, Garrett and Dunner

[57] ABSTRACT

An impregnation pitch having a Kraemer-Sarnow softening point ranging from about 60° C. to 80° C., a content of quinoline-insoluble substances less than or equal to 7% by weight, and a filterability index greater than or equal to 4.5. A process for the manufacture thereof, wherein a tar or a pitch having a Kraemer-Sarnow softening point not exceeding 60° C. and a content of quinoline-insoluble substances below or equal to 7% by weight is subjected to a thermal treatment capable of removing constituents with a molecular mass of below 1,200.

13 Claims, 3 Drawing Sheets

IMPREGNATION PITCH WITH IMPROVED FILTERABILITY AND PROCESS FOR ITS MANUFACTURE

BACKGROUND OF THE INVENTION

The present invention relates to pitches, in particular to coal tar pitches, which are intended to be employed as agents for impregnating carbon or graphite components to increase the density and mechanical strength of these components. In this specification, these pitches will be referred to by the term "impregnation pitch".

In general, pitches are characterized by various analytical data, the knowledge of which enables their utility value for the chosen application to be assessed. A list of the various characteristics of pitches, which will be referred to in this case, is given below:

(1) The content of substances which are insoluble in quinoline (QI), and the content of substances insoluble in toluene (TI) which are expressed in percent by weight, are obtained by the operating procedures given in the standards ISO 6791 and ISO 6376 respectively;

(2) A Kraemer-Sarnow softening point (KS), which is expressed in °C., is determined according to the mercury procedure specified in DIN standard 52025;

(3)The fixed carbon content (FC), which is expressed in percent by weight, reflects the coke yield or the carbon value of the pitch and is calculated according to the method described in ISO standard 6998.

A pitch which is considered to be satisfactory to form an impregnation pitch should meet the following specifications:

(1) a KS softening point ranging from about 60° C. to 80° C.;

(2) a content of quinoline-insoluble substances (QI) which is generally below or equal to 7% by weight; and (3) content (FC) of at least 46%; for example, of between 46% and 54% by weight.

However, the essential criterion of success of an impregnation pitch consists of another measurement, namely, the rate of filtration or filterability index. This criterion is characteristic of coal tar pitches because it reflects the impregnating nature of the pitch. The filterability indexes have been determined in this case by the method described below. In a filtration cell, identical to that described by J. W. Clarke, T. D. Rantell in the periodical "Fuel", 1980, 59, 35–41, a sample of about 50 g of the pitch to be analyzed, which is heated beforehand in an oven, is subjected to filtration through a metal centered disc at a constant pressure of $5\times10^5$ Pa and at a constant temperature of 225° C. The curve $m=f(t)$ is recorded (where m is the mass of the filtered pitch expressed in grams and t is the time expressed in minutes), and the filterability index (I) is calculated according to the formula:

$$I = \frac{m_2 - m_1}{t_2/m_2 - t_1/m_1}$$

wherein $m_1$ is mass collected at time $t_1$; and $m_2$ is mass collected at time $t_2$.

Until now, it was thought by a person skilled in the art that the thermal maturation treatment of an impregnation pitch had no influence on, or was even disadvantageous to, the rate of filtration.

SUMMARY OF THE INVENTION

It has been unexpectedly discovered that the filterability of an impregnation pitch and, hence the impregnation nature of the pitch, could be considerably improved by a moderate maturation of the pitch.

Furthermore, analysis by gel permeation chromatography (GPC) of impregnation pitches which have and which have not been treated thermally has made it possible to ascertain that the improvement in the filterability index of a pitch is correlated with (A) the removal of the materials of molecular mass of below 1,200, and preferably of between 500 and 1,100, and (B) an increase in the proportion of the quinoline-insoluble particles having a diameter ranging from about 8–10 μm, i.e., particles representative of the mesophase. Thus, it appears as if the molecules which are found to disappear from the pitch matrix reappeared in a mesophase. Observation of the quinoline-insoluble substances using electron microscopy confirms that, in the case of the pitches which have been thermally treated, the minute quinoline-insoluble particles become adsorbed on the mesophase particles. As a result of this, the blocking phenomena which are detrimental to obtaining a good filterability index and which were caused by these small-sized particles, are found to be suppressed.

The present invention provides an impregnation pitch having a KS softening point ranging from about 60° to 80° C., a content of quinoline-insoluble substances less than or equal to approximately 7% by weight, and a filterability index greater than or equal to 4.5. The impregnation pitch according to the invention preferably has a fixed carbon content of at least 46% by weight.

The present invention also provides a process for the manufacture of an impregnation pitch having the aforementioned characteristics, wherein a tar or a soft pitch, having a KS softening point not exceeding 60° C. and a content of quinoline insoluble substances not exceeding 7% by weight, is subjected to a thermal treatment capable of removing a substantial portion of its constituents with a molecular mass of below 1,200.

BRIEF DESCRIPTION OF THE DRAWINGS

FIG. 4: Scanning electron microscopy of the quinoline-insoluble particles of Examples 1 to 5 are shown.

DETAILED DESCRIPTION OF A PREFERRED EMBODIMENT

In accordance with a preferred embodiment of the present process, the thermal treatment is carried out at a temperature of between 350° C. and 430° C. and for a period of 1 to 50 hours and followed by a flash distillation. For obvious kinetic reasons, when a lower temperature is used, a proportionately longer treatment time is chosen. For example, when the temperature ranges from about 400° C. to 420° C., the period of treatment is from 2 to 7 hours.

The following examples are presented to illustrate the various features of the invention.

EXAMPLES 1to 5

All impregnation pitch examples were prepared from the same single coal tar sample. The pitch of Example 1 (comparative example) was obtained by direct distillation and without thermal treatment. The pitches of Example 2 to 5, which were prepared in accordance with the invention, were subjected to a thermal treatment at a temperature T (expressed in °C.) and for a time t (expressed in hours), and then to a flash distillation. The characteristics of the pitches obtained in this manner are shown in the table below, together with the numerical value (in arbitrary units) of the surface area S obtained by integration of the curve in FIG. 1*c* as explained below.

TABLE

| Example | T (°C.) | t (h) | KS (°C.) | QI (%) | FC (%) | I | S |
|---|---|---|---|---|---|---|---|
| 1 | — | — | 72 | 2.3 | 48.4 | 3.0 | 0 |
| 2 | 400 | 3 | 70 | 2.4 | 48.7 | 7.0 | 6.1 |
| 3 | 410 | 3 | 66.5 | 2.4 | 47.4 | 7.4 | 9.9 |
| 4 | 420 | 4 | 69.5 | 4.5 | 51.3 | 13.7 | 10.7 |
| 5 | 420 | 7 | 67 | 5.6 | 51.2 | 300 | 12.3 |

Figure 1A:
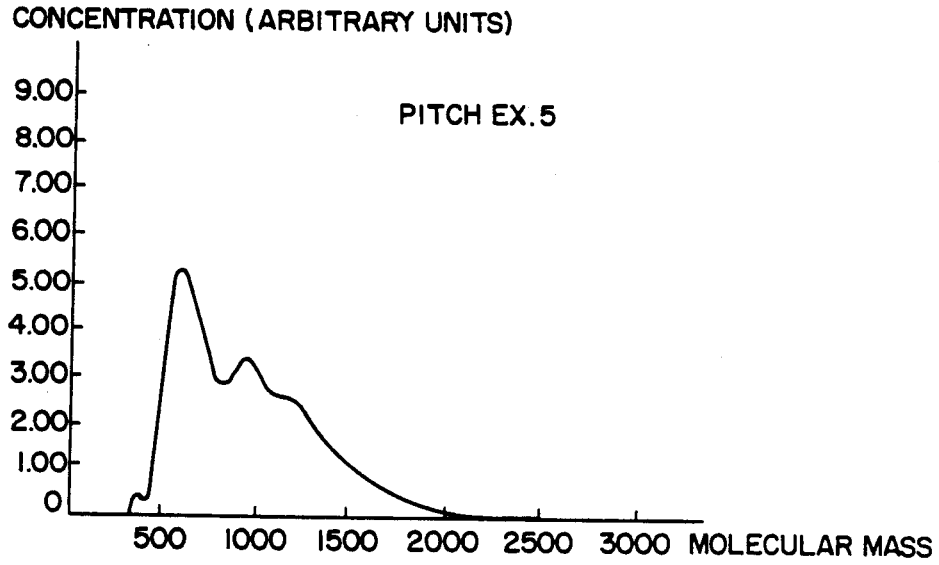
FIG. 1*a*: The gel permeation chromatography (GPC) curve of the pitch of Example 5 is plotted.
Figure 1B:
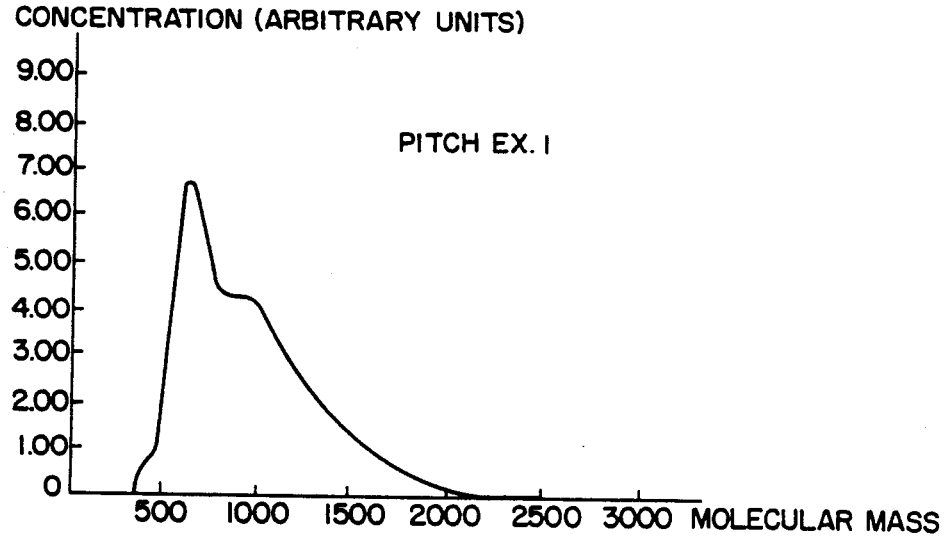
FIG. 1*b*: The GPC curve of the pitch of Example 1 is plotted.

The molecular masses of the pitches are determined by gel permeation chromatography (GPC) in 1,2,4-trichlorobenzene at 135° C. The calibration is carried out with the aid of pitch fractions which have been collected by preparative GPC and whose molecular masses have been determined by osmometry. When the GPC curve of the pitch of Example 5 (FIG. 1*a*) was subtracted from that of the pitch of Example 1 (FIG. 1*b*), the curve represented by FIG. 1*c* was obtained. Inspection of these curves revealed that any improvement in the filterability index of a pitch was directly related to the removal of materials with molecular masses ranging from about 300 to 1,200.

Figure 1C:
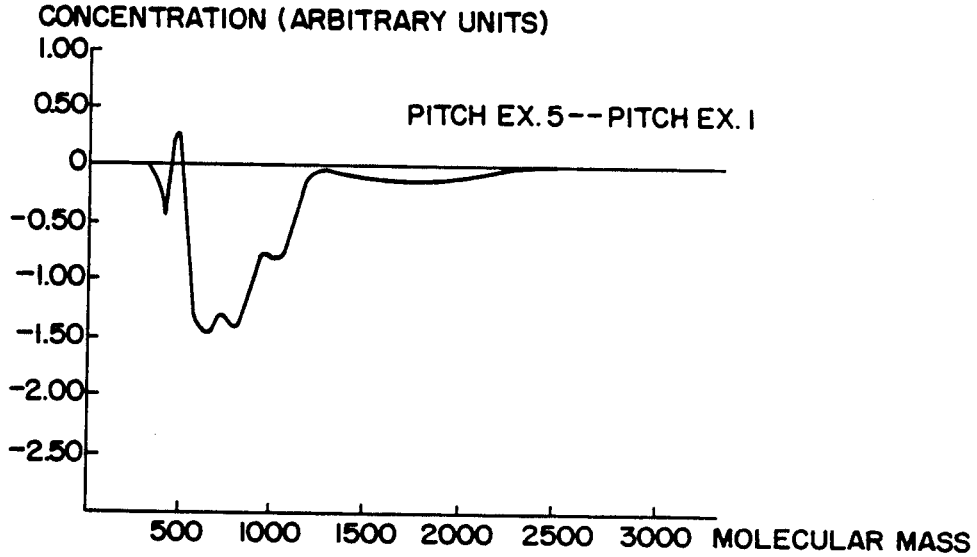
FIG. 1*c*: the GPC curve resulting from the curve of FIG. 1*b* being subtracted from the curve of FIG. 1*a* is plotted.
Figure 2:
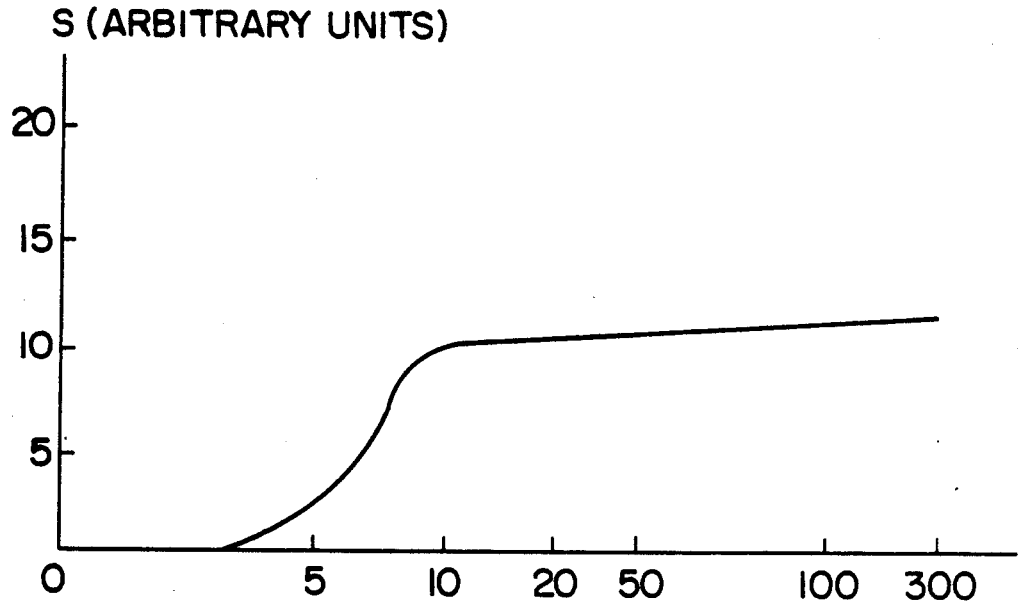
FIG. 2: The surface area (S) obtained by integration of the peak(s) of the curve in FIG. 1*c* and of the corresponding curves of the pitches of Examples 2–4 between the values 300 and 1,200 for the molecular masses versus the filterability indexes are plotted.

The surface area S, obtained by integration of the peak(s) of the curve in FIG. 1*c* and of the corresponding curves for the pitches of Examples 2 to 4 between the values 300 and 1,200 for the molecular masses, was then calculated. These surface areas were plotted as ordinates, with the filterability indexes plotted as abscissae, to plot the curve in FIG. 2. It was found that the improvement in the filterability index of a pitch was proportionately greater, when a greater amount of the materials having molecular masses ranging from about 300 to 1,200 were removed.

Figure 3:
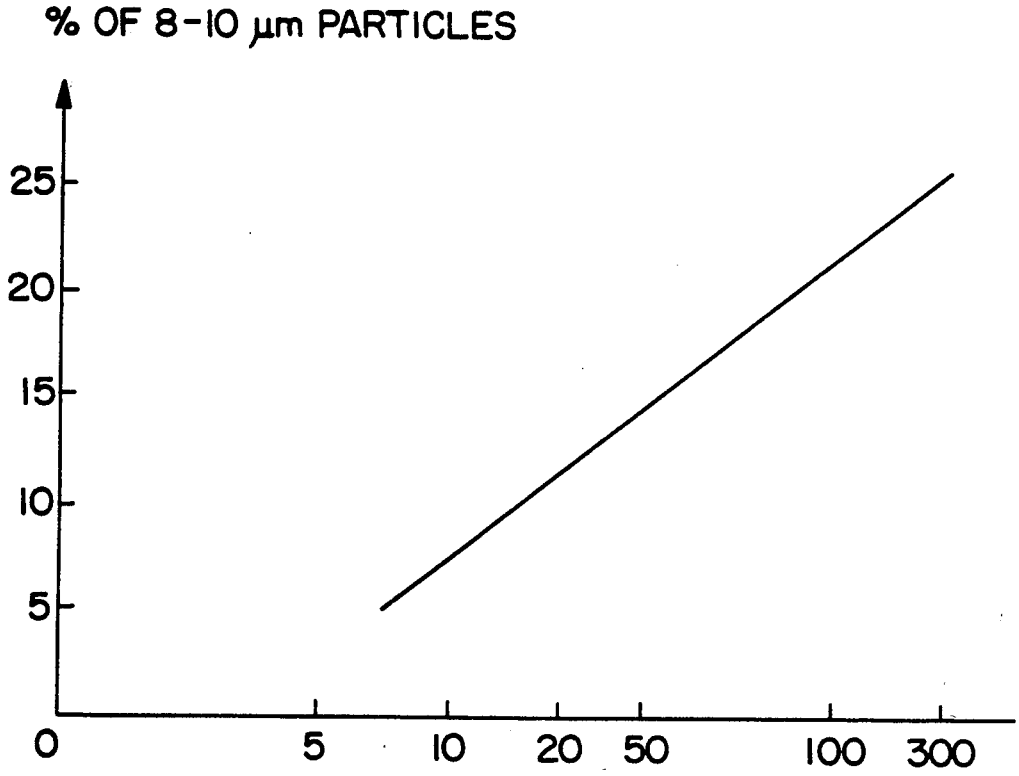
FIG. 3: The weight percentages of the largest quinoline-insoluble particles versus the filterability indexes are plotted.

Lastly, the particle size distribution of the quinoline-insoluble particles was investigated. The weight percentages of the largest quinoline-insoluble particles (diameter of between 8 and 10 μm) were plotted as ordinates for each of the pitches analyzed, and the filterability indexes were plotted as abscissae to obtain the curve in FIG. 3. By this manner, it was found that the filterability index increased progressively with an increase in weight percent of these particles, which are representative of the mesophase.

The appearance of these particles was observed by scanning by electron microscopy in parallel with this investigation. The photographic images obtained for the pitches of Examples 1 and 5 (FIG. 4) showed a change in the nature of the quinoline-insoluble substances. The particles of the "carbon black" type, approximately 1–2 μm in diameter corresponding to Example 1, changed to mesophasic agglomerates approximately 8–10 μm in diameter, having adsorbed the former particles (See Example 5 in FIG. 4). These agglomerates originate from polycondensation phenomena which occurs subsequent to the thermal treating step.

It will be apparent to those skilled in the art that various modifications and variations could be made in the invention without deviating from the scope or spirit of the invention.

What is claimed is:

1. An impregnation pitch having a Kraemer-Sarnow softening point ranging from about 60° C. to 80° C., a content of quinoline-insoluble substances less than or equal to 7% by weight, and a filterability index greater than or equal to 4.5.

2. The impregnation pitch of claim 1, further including a fixed carbon content which is at least equal to 46% by weight.

3. The impregnation pitch of claim 1, wherein the quinoline-insoluble substances comprises mesophase particles ranging from about 8 to 10 μm in diameter.

4. The impregnation pitch of claim 1, wherein a substantial portion of the pitch is free of constituents having a molecular mass below 1,200.

5. The impregnation pitch of claim 4, wherein the quinoline insoluble substance comprises mesophase particles ranging from about 8 to 10 μm in diameter.

6. The impregnation pitch of claim 5, further including a fixed carbon content which is at least equal to 46% by weight.

7. The impregnation pitch of claim 6, wherein a substantial portion of the pitch is free of constituents having a molecular mass between 300 and 1,200.

8. A process for the manufacture of an impregnation pitch having a filterability index greater than or equal to 4.5 which comprises thermally treating a pitch having a Kraemer-Sarnow softening point not exceeding 60° C. and a content of quinoline insoluble substances not exceeding 7% by weight to remove constituents of the tar having a molecular mass below 1,200.

9. The process of claim 8, wherein the step of thermally treating the pitch is followed by a flash distillation of the pitch.

10. The process of claim 8, wherein the thermal treatment is carried out at a temperature ranging from about 350° C. to 430° C. for a period of about 1 to 50 hours.

11. The process of claim 9, wherein the thermal treatment is carried out at a temperature of about 400° C. to 420° C.

12. The process of claim 9, wherein the thermal treating step a substantial portion of the constituents of the pitch having a molecular mass between 300 and 1,200 are removed.

13. The process of claim 9, wherein the treatment is carried out for a period of 2 to 7 hours.

* * * * *